United States Patent [19]

Inaba

[11] 4,216,995

[45] Aug. 12, 1980

[54] COLLAPSIBLE CHAIR

[75] Inventor: Yoshisada Inaba, Osaka, Japan

[73] Assignee: Shinsei Kinzoku Seisakusho, Osaka, Japan

[21] Appl. No.: 16,964

[22] Filed: Mar. 5, 1979

Related U.S. Application Data

[63] Continuation of Ser. No. 832,550, Sep. 12, 1978, abandoned.

[30] Foreign Application Priority Data

Feb. 18, 1977 [JP] Japan ..... 52/17301

[51] Int. Cl.[2] ..... A47C 7/00

[52] U.S. Cl. ..... 297/443; 248/188; 297/451

[58] Field of Search ..... 248/188; 297/172, 416, 297/440, 443, 451; 403/247, 293

[56] References Cited

U.S. PATENT DOCUMENTS

| | | | |
|---|---|---|---|
| 2,687,166 | 8/1954 | Hamilton | 297/451 X |
| 2,746,525 | 5/1956 | Cooper | 297/440 X |
| 3,173,723 | 3/1965 | Hoven et al. | 297/451 |

*Primary Examiner*—James C. Mitchell
*Attorney, Agent, or Firm*—Koda and Androlia

[57] ABSTRACT

A collapsible chair including a seat, an applied plate, a back support and a seat support. The seat includes a pair of separated stoppers provided on the front bottom surface of the seat, a pair of first fixing frames corresponding with and adjacent to the stoppers, a hole having a notch therein formed in the first frames, a pair of second fixing frames provided on the rear bottom surface of the seat and corresponding with the first fixing frames and holes having a notch therein provided in the second frames. The applied plate fits on the bottom surface of the seat between the first and second fixing frames and includes curved edges for engaging with a pipe and a joining part provided in the center of the applied plate for engaging with the seat support. The back support is coupled to the seat by a pair of curved pipes which are coupled to the back support at one end and whose other end extends through the holes in the first and second fixing frames and the curved edges of the applied plate. A projection is provided on the end of the pipe and the projection fits through the notches in the holes and is for locking the pipes to the seat.

5 Claims, 5 Drawing Figures

COLLAPSIBLE CHAIR

This is a continuation of application Ser. No. 832,550, filed Sept. 12, 1978, now abandoned.

BACKGROUND OF THE INVENTION

1. Field of the Invention

This invention relates to furniture and more particularly to collapsible furniture.

2. Prior Art

In the prior art there exists several types of collapsible or disassemblable chairs. Such chairs typically suffer from several disadvantages. Firstly, they are usually too weak and usually break in a relatively short period of time. Secondly, if they are strong enough, they are either too heavy or too large to carry or to store. Thirdly, if they are not too heavy but are still strong enough, they are usually complex and expensive to manufacture.

SUMMARY OF THE INVENTION

Accordingly, it is a general object to provide a collapsible chair with sufficient strength which is also relatively simple.

It is another object to provide a collapsible chair which is light weight and easily transported and stored.

It is yet another object of the present invention to provide a collapsible chair which can be easily disassembled and assembled.

It is still another object of the present invention to provide a collapsible chair which can be easily manufactured by automatic machinery.

In keeping with the principles of the present invention, the objects are accomplished by a unique collapsible chair including a seat, an applied plate, a back support and a seat support. The seat includes a pair of separated stoppers provided on the front bottom surface of the seat, a pair of first fixing frames corresponding with and adjacent to the stoppers, a hole having a notch therein formed in the first frames, a pair of second fixing frames provided on the rear bottom surface of the seat and corresponding with first fixing frames and holes having a notch therein provided in the second frames. The applied plate fits on the bottom surface of the seat between the first and second fixing frames and includes curved edges for engaging with a pipe and a joinging part provided in the center of the applied plate for engaging with the seat support. The back suppor is coupled to the seat by a pair of curved pipes which are coupled to the back support at one end and whose other end extends through the holes in the first and second fixing frames and the curved edges of the applied plate. A projection is provided on the end of the pipe and the projection fits through the notches in the holes and is for locking the pipes to the seat.

BRIEF DESCRIPTION OF THE DRAWINGS

The principles and objects of the present invention will become more apparent in the following description in conjunction with the following drawings wherein like elements are given like reference numerals and in which.

DESCRIPTION OF THE PREFERRED EMBODIMENT

Figure 1:
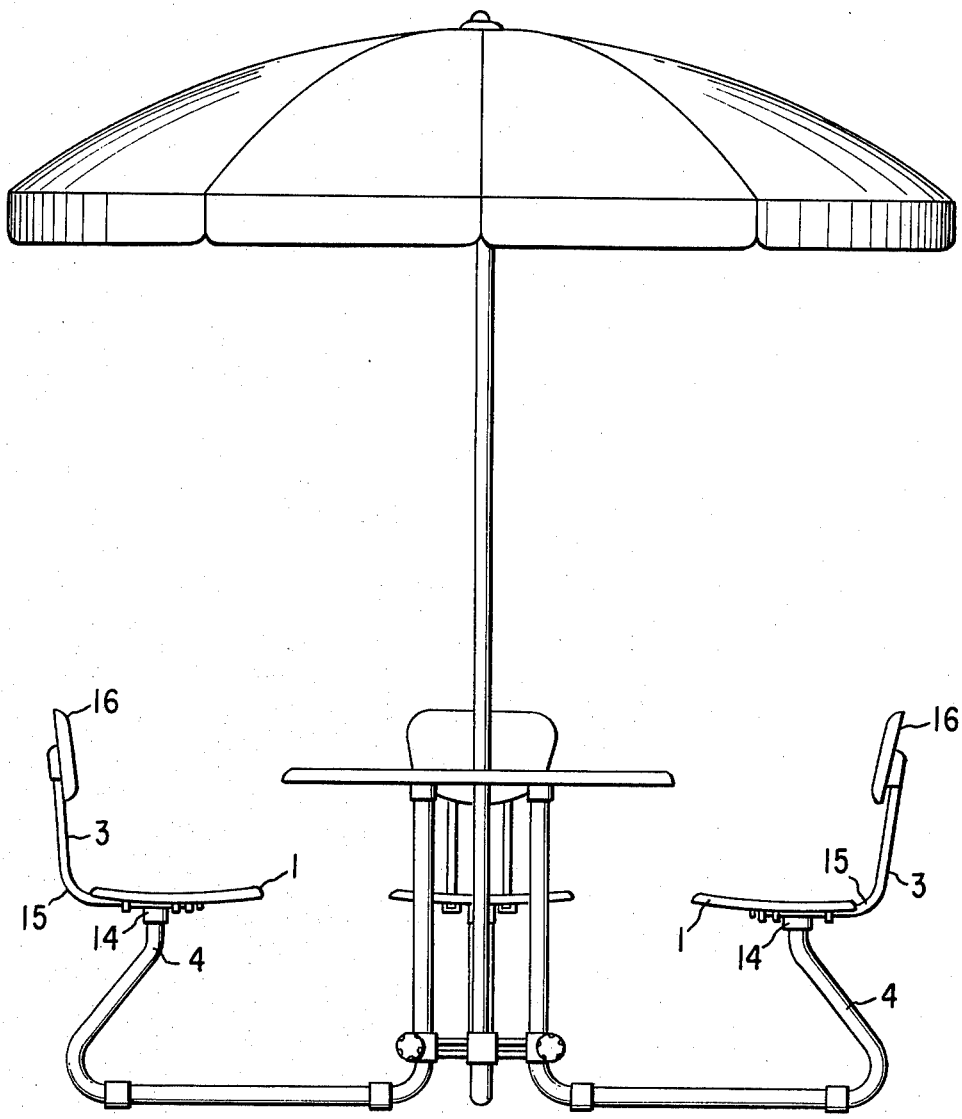
FIG. 1 is a front view of an embodiment of a collapsible chair in an assembled form in accordance with the present invention.
Figures 2, 5:
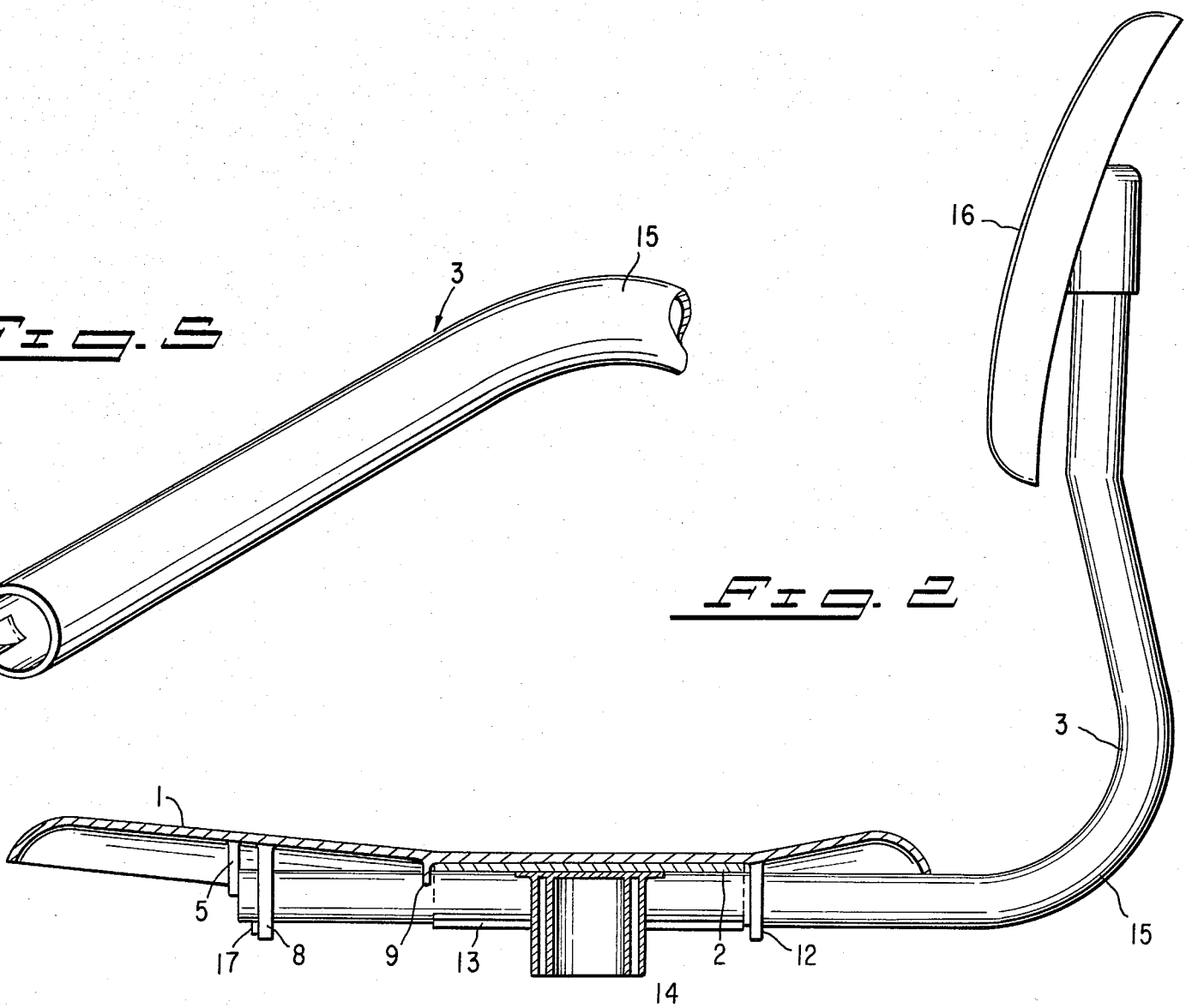
FIG. 2 is a sectional view showing the assemblage of the chair.
FIG. 5 is a perspective view of a part of a connecting pipe.
Figure 3:
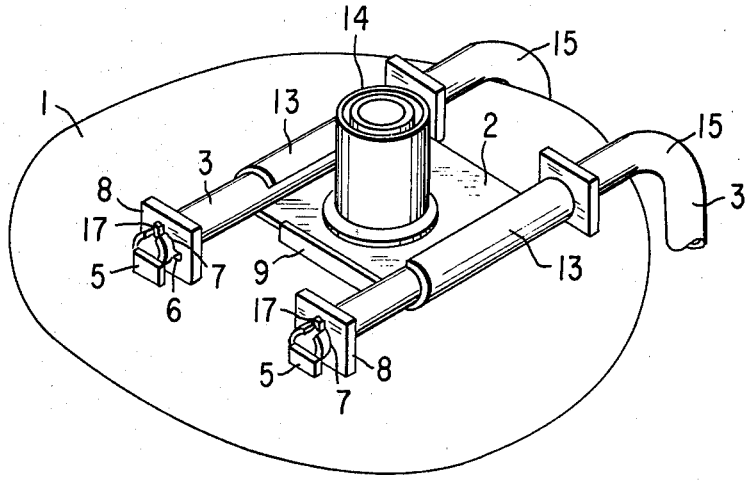
FIG. 3 is a perspective view showing the reverse side of the seat.

The present invention is directed to a collapsible chair consisting of a seat 1, an applied Plate 2, two curved connecting pipes 3 and a support pipe 4.

The seat 1 is made of plastic board or the like and curved from the view point of human engineering for comfortable sitting. Projecting from the front on the reverse die of the seat 1 are two stoppers 5 separated from each other. Two fixing frames 8, each of which having a hole 7 with a notch 6, are, corresponding to and in close vicinity to the stoppers 5, also projecting from the reverse side of seat 1. A parting strip 9 is provided behind the fixing frames 8 and in the back part on the reverse side of the seat 1. Two fixing frames 12, each of which having a hole 11 with a notch 10, are provided on the seat 1 and in correspondence with frames 8.

Applied plate 2 is, on the reverse side of the seat 1, to be sandwiched in between the fixing frames 12 and the parting strip 9. Two sides of the applied plate 2 are curved inside and form two holding parts 13 so as to hold the connecting pipes 3. On the center of the applied plate 2, a joining part 14 is formed into which the edge of support pipe 4 standing on the ground or on the floor is inserted.

One arm of the connecting pipes 3 is fixed to the reverse side of the seat 1 and the other arm of the connecting pipes 3. Connecting pipes 3 are curved at parts 5, and support a back-supporting-plate 16. The connecting pipes 3 are made of metal and designed so as to go through the holes 7 of the fixing frames 8, the holes 11 of the fixing frames 12 and the holding parts 13 of the applied plate 2. At the edge of the ends of the connecting pipes 3, a projection 17 is formed that can go through the said openings 6 and 10.

The assembly of the chair using the above parts is performed like the following.

Figure 4:
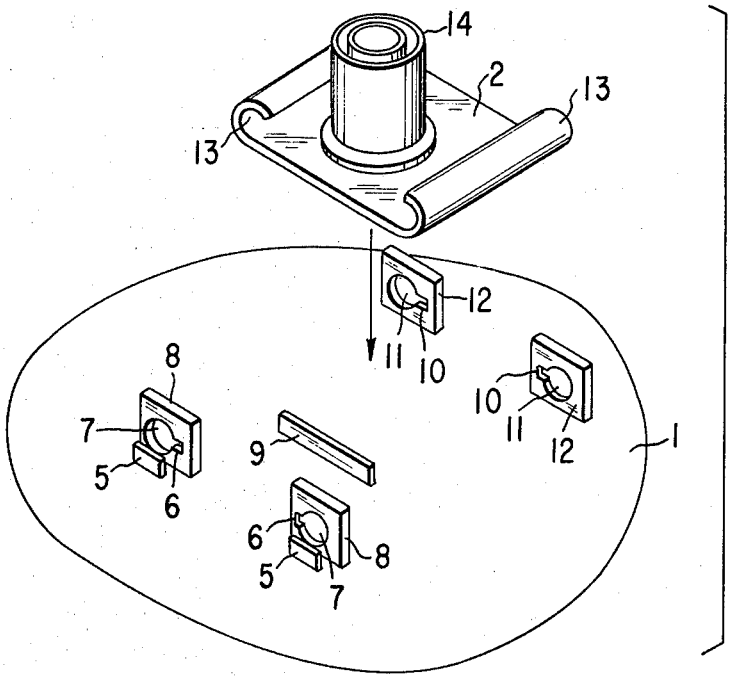
FIG. 4 is a perspective view showing the disassembled reverse side of the seat.

The assembly is started by applying the applied plate 2 to the fixed place of the reverse side of the seat 1 as shown in FIG. 4. The two connecting pipes 3 are passed through the holes 11 of the fixing frames 12, the holding parts 13 of the applied plate 2 and the holes 7 of the fixing frames 8. This is followed by letting the edges of the pipes 3 strike on the stoppers 5 and rotating the pipes 3 so that the pipes 3 stand up to support the back-supporting-plate 16. The projections 17 strike on the front of the fixing frames 8 so that the pipes 3 cannot come out. As shown in the illustrated embodiment, the openings 6 and 10 are formed so as to face inside and the projections 17 are, after going through the holes 6 and 10, fixed facing to the floor or ground. However, various embodiments and arrangements of the openings 6 and 10 and projection 17 are possible.

By connecting the connecting pipes 3 as described above, the seat 1, the applied plate 2 and the connecting pipes 3 can be assembled so as not to come apart. Accordingly, the assembly is completed by connecting the back-supportingplate 16 to the other end of the connecting pipes 3 and by joining the support pipe 4 and the joining part 14 together. In addition, although FIG. 1 illustrates chairs in association with a table for outdoor use, the chair of the present invention can be embodied as the chair for office-use and so on in association with covers with cushion on the seat 1 and the back-supporting-plate 16 and although the applied plate 2 is, in the illustrations, fixed between and with the parting strip 9 and the fixing frames 12, the applied plate 2 can be fixed in various ways as the plate 2 can be fixed between the fixing frames 12 and 8 or in a hollow that can be formed on the reverse side of the seat 1.

The chair of the present invention has sufficient strength without the seat 1 being made thick because, as shown in the above, the seat 1 is supported by the applied plate 2 and the connecting pipes 3 on its reverse side. Moreover, the assembly and disassembly of the chair can be performed extremely easily and quickly and the chair can be stored very compactly after being disassembled and, accordingly, the disassembled chair can be conveniently carried and kept in custody.

In all cases, it is understood that the above described ambodiment is merely illustrative of but a one of the many possible specific embodiments which can represent the application of the principles of the present invention. Numerous and varied other arrangements can be readily devised in accordance with these principles by those skilled in the art without departing from the spirit and scope of the invention.

I claim:

1. A collapsible chair comprising:

a seat, said seat comprising:

a pair of stops provided on a front bottom surface of said seat;

a pair of first brackets provided on said bottom surface of said seat and corresponding with and adjacent to said stops;

a hole formed in each of said first brackets;

a pair of second brackets provided on a rear bottom surface of said seat and corresponding with said first brackets; and a hole formed in each of said second brackets;

a plate detachably fixed to said bottom surface of said seat between said first and second brackets, said plate comprising:

curved edges for engaing with a pipe; and a seat coupling provided on a bottom surface of said plate;

a back rest, said back rest being coupled to said seat by a pair of curved pipes which are coupled to said back rest at one end and whose other end extends through said holes in said first and second brackets, engages with said curved edges of said plate and abuts said stops; and a seat support post, said seat support post engaging with said seat coupling;

whereby said seat, plate, back rest and seat support post are detachably coupled together to form a chair.

2. A collapsible chair according to claim 1 wherein said holes in said first and second brackets are provided with notches and said pipes are provided with a projection at one end which fits through said notches of said holes in said first and second brackets during assembly of said collapsible chair and which abut a front surface of said first brackets when said chair is completely assembled.

3. A collapsible chair according to claim 2, wherein said seat support and back rest are made from plastic.

4. A collapsible chair according to claim 3, wherein said plate is metal.

5. A collapsible chair according to claim 4 further comprising an elongated stop provided on the bottom surface of said seat between said first and second brackets for engaging with an edge of said plate.

* * * * *